US007356283B2

(12) United States Patent
Igarashi

(10) Patent No.: US 7,356,283 B2
(45) Date of Patent: Apr. 8, 2008

(54) TANDEM TYPE IMAGE-FORMING APPARATUS

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/377,350

(22) Filed: Mar. 17, 2006

(65) Prior Publication Data

US 2006/0210303 A1 Sep. 21, 2006

(30) Foreign Application Priority Data

Mar. 17, 2005 (JP) ..... 2005-077566

(51) Int. Cl.
*G03G 21/16* (2006.01)
*G03G 15/00* (2006.01)

(52) U.S. Cl. ..... 399/111; 399/118; 399/223

(58) Field of Classification Search ..... 399/110, 399/111, 118, 223, 224, 231
See application file for complete search history.

(56) References Cited

U.S. PATENT DOCUMENTS

| | | | | |
|---|---|---|---|---|
| 6,741,820 | B2 * | 5/2004 | Nobe et al. | 399/110 |
| 2002/0141785 | A1 * | 10/2002 | Sato et al. | 399/223 |
| 2004/0179859 | A1 | 9/2004 | Ishii | |
| 2005/0191086 | A1 * | 9/2005 | Kawai et al. | 399/110 |
| 2005/0191087 | A1 * | 9/2005 | Nishimura | 399/111 |

FOREIGN PATENT DOCUMENTS

| | | | |
|---|---|---|---|
| JP | 1063151 | | 3/1998 |
| JP | 2002166593 | | 6/2002 |
| JP | 2002311662 | A * | 10/2002 |
| JP | 2003186348 | | 7/2003 |
| JP | 2004279689 | | 10/2004 |
| JP | 2004279704 | | 10/2004 |

* cited by examiner

*Primary Examiner*—David M. Gray
*Assistant Examiner*—Joseph S. Wong
(74) *Attorney, Agent, or Firm*—Baker Botts L.L.P.

(57) ABSTRACT

In an image-forming apparatus, a main device body has a first side surface and a second side surface opposite to the first side surface. An opening is formed in the first side surface. A cover covers the opening and is capable of opening and closing thereon. A plurality of process cartridges are capable of being mounted in or removed from the main device body through the opening. The process cartridges are arranged in a row in the main device body when the process cartridge are mounted in the main device body. Each process cartridge is oriented, when the each process cartridge is mounted in the main device body, with its developer-accommodating section facing the first side surface and the image-holding member facing the second side surface. An exposure device is integrally provided on the cover and irradiates a light beam on each image-holding member. The conveying unit conveys a sheet to a position opposing each image-holding member, thereby allowing a developer image to be transferred from each image-holding member onto the sheet. A tray supports the sheet after the sheet has been formed with the developer image from at least one of the image-holding members.

18 Claims, 4 Drawing Sheets

RELATED ART

RELATED ART

TANDEM TYPE IMAGE-FORMING APPARATUS

CROSS REFERENCE TO RELATED APPLICATION

This application claims priority from Japanese Patent Application No. 2005-77566 filed Mar. 17, 2005. The entire content of this priority application is incorporated herein by reference.

TECHNICAL FIELD

The disclosure relates to an image-forming apparatus, and particularly to a tandem type image-forming apparatus.

BACKGROUND

A vertical tandem type laser printer is disclosed in Japanese unexamined patent application publication No. 2003-186348. The vertical tandem type laser printer is one type of electrophotographic image-forming apparatus.

SUMMARY

FIGS. 1 and 2 show the structure of a conceivable vertical tandem type laser printer.

As shown in FIGS. 1 and 2, the conceivable laser printer 100 includes four process cartridges 103 to correspond to the four colors used in image formation. Each process cartridge 103 has a photosensitive drum 101 and a toner-accommodating section 102. The process cartridges 103 are accommodated in a main device body 104 of the laser printer 100 so as to be stacked vertically.

The laser printer 100 further includes a paper cassette 105 disposed in a lower section of the main device body 104 for accommodating a paper 106, and a conveying belt 107 disposed in a front section of the main device body 104 for conveying the paper 106 supplied from the paper cassette 105 in an upward direction. The process cartridges 103 are disposed so that the photosensitive drums 101 oppose the conveying belt 107. The conveying belt 107 is retained in a cover 108 disposed on the front surface of the main device body 104 that is capable of opening and closing on the front surface. The process cartridges 103 can be mounted in or removed from the main device body 104 by opening the cover 108 together with the conveying belt 107 as shown in FIG. 2. An exposure device 109 for irradiating light on the photosensitive drums 101 is disposed on the rear side of the process cartridges 103. The laser printer 100 further includes a fixing unit 110 and a discharge tray 111 disposed in a top section of the main device body 104.

With this construction, after the paper 106 conveyed upward along the conveying belt 107 passes through the fixing unit 110, the paper 106 curves toward the rear side of the main device body 104 to be discharged onto the discharge tray 111.

However, in the conceivable laser printer 100 having the construction described above, the process cartridges 103 are mounted in an orientation that positions the photosensitive drums 101 on the near side (the cover 108 side) of the main device body 104 and the toner-accommodating sections 102 on the inner side (side opposite the cover 108). Consequently, when replacing the process cartridges 103, it is not convenient to handle the process cartridges 103 with the photosensitive drums 101 on the near side. However, it is difficult to configure this type of laser printer 100 so that the process cartridges 103 can be mounted and removed by handling the toner-accommodating section 102 side since the exposure device 109 blocks the rear side of the toner-accommodating sections 102.

In view of the foregoing, it is an object of the invention to provide an image-forming apparatus capable of facilitating handling of the process cartridges.

In order to attain the above and other objects, the invention provides an image-forming apparatus including: a main device body; a cover; a plurality of process cartridges; an exposure device; a conveying unit; and a tray. The main device body has a first side surface and a second side surface opposite to the first side surface. An opening is formed in the first side surface. The cover covers the opening in the main device body and is capable of opening and closing thereon. The plurality of process cartridges are capable of being mounted in or removed from the main device body through the opening. The process cartridges are arranged in a row in the main device body when the process cartridge are mounted in the main device body. Each process cartridge includes a developer-accommodating section, an image-holding member, and a developing member. The developer-accommodating section accommodates developer. The image-holding member forms an electrostatic latent image thereon. The developing member develops the electrostatic latent image onto a developer image by using the developer supplied from the developer-accommodating section, thereby allowing the image-holding member to carry the developer image thereon. Each process cartridge is oriented, when the each process cartridge is mounted in the main device body, with its developer-accommodating section facing the first side surface and the image-holding member facing the second side surface. An exposure device is integrally provided on the cover and irradiates a light beam on each image-holding member to form the electrostatic latent image thereon. The conveying unit conveys a sheet to a position opposing each image-holding member, thereby allowing the developer image to be transferred from each image-holding member onto the sheet. The tray supports the sheet after the sheet has been formed with the developer image from at least one of the image-holding members.

DETAILED DESCRIPTION

A vertical tandem type color laser printer according to an illustrative aspect of the invention will be described with reference to FIGS. 3 and 4.

Figure 1:
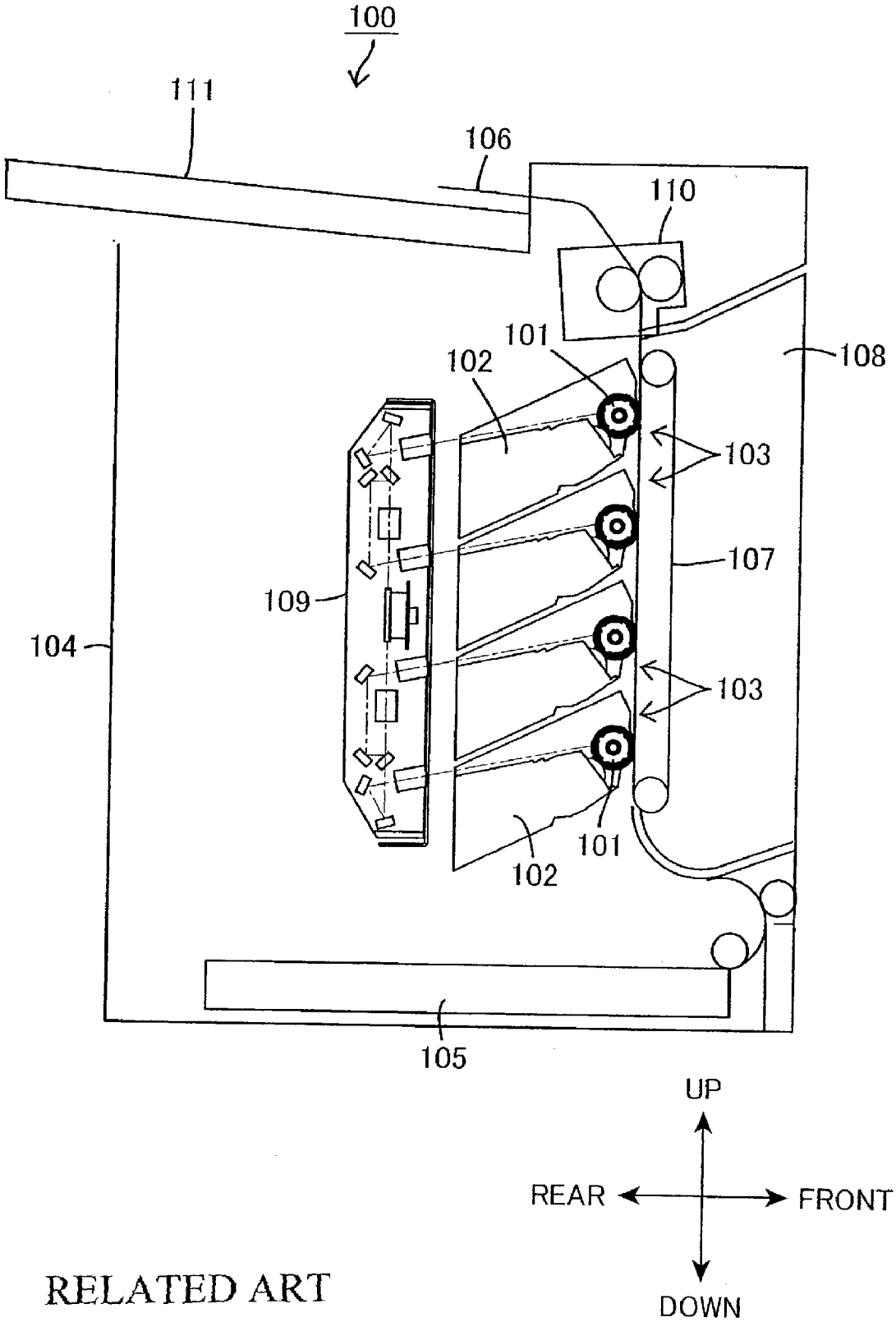
FIG. 1 is a cross-sectional view of a conceivable laser printer when a cover is closed thereon.
Figure 2:
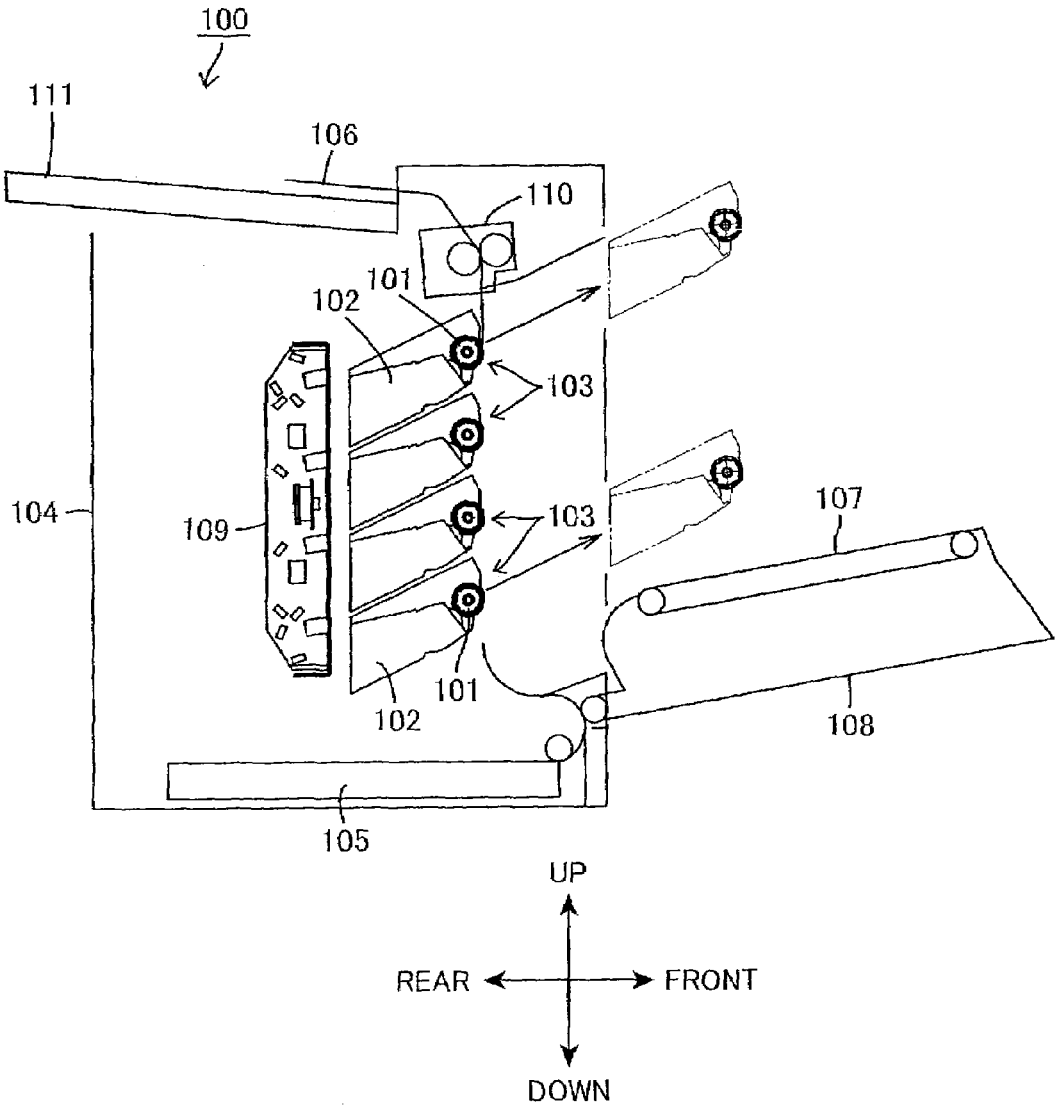
FIG. 2 is a cross-sectional view of the conceivable laser printer in FIG. 1 when the cover is open.
Figure 3:
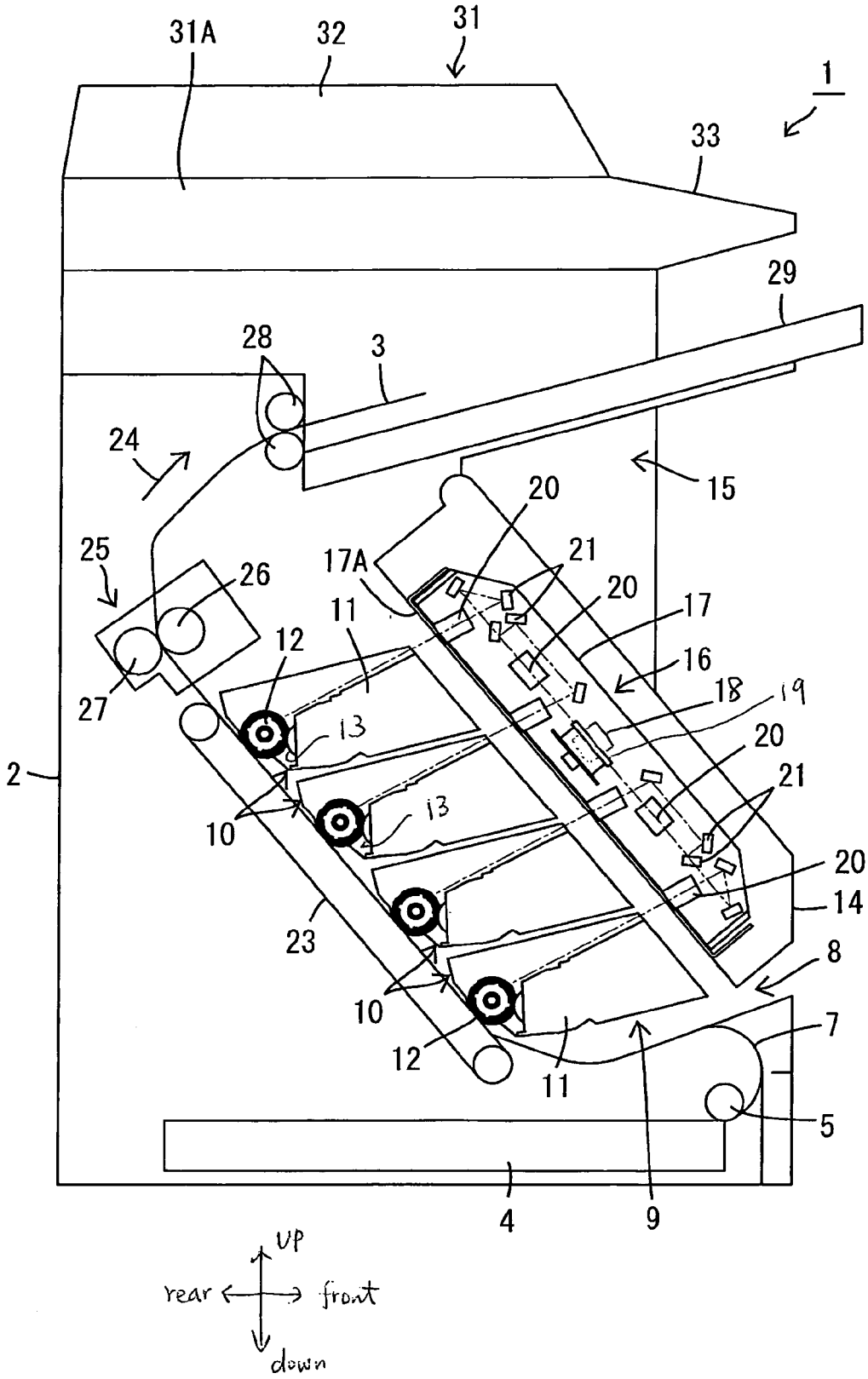
FIG. 3 is a cross-sectional view of a laser printer according to an illustrative aspect of the invention when a cover is closed thereon.
Figure 4:
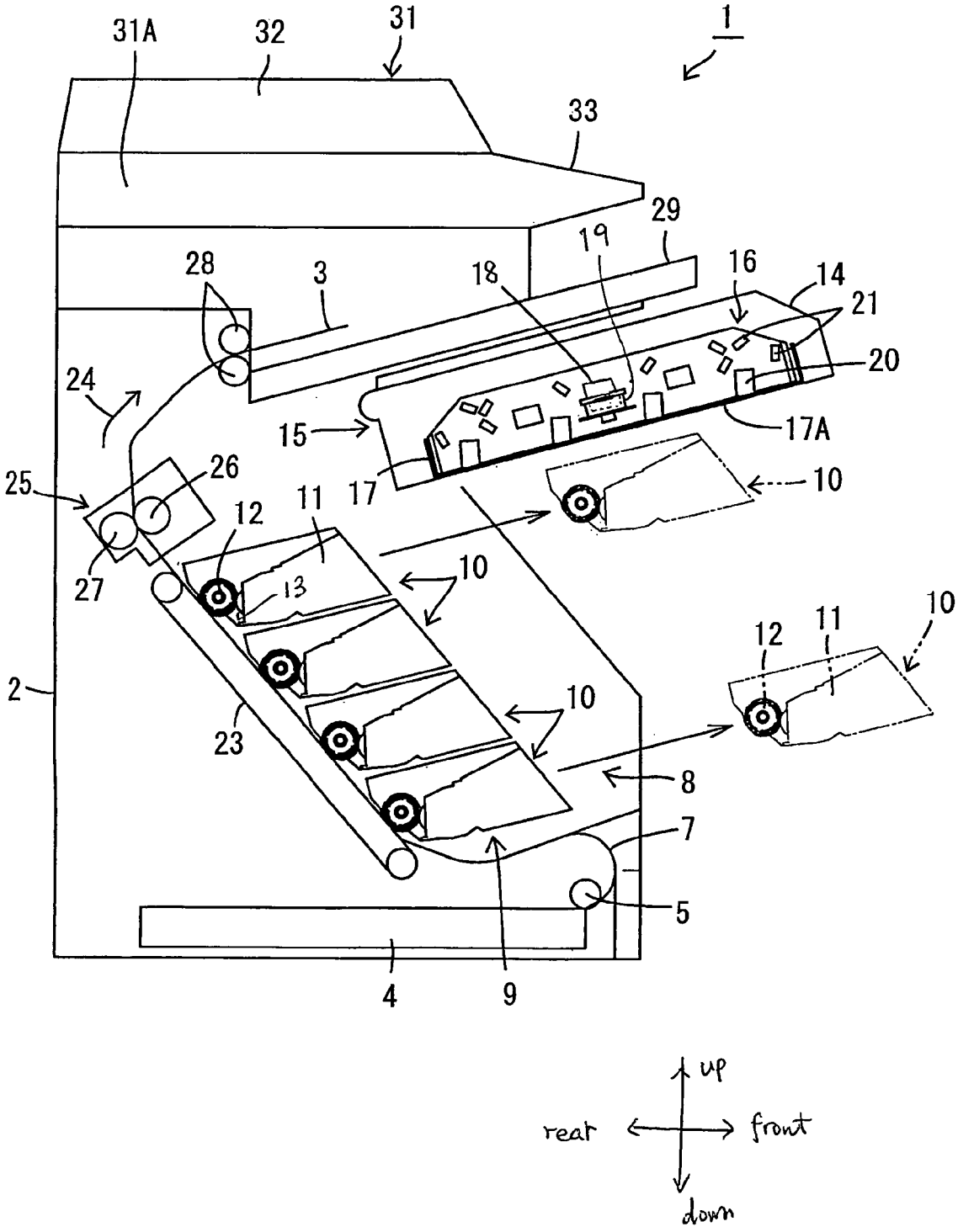
FIG. 4 is a cross-sectional view of the laser printer in FIG. 3 when the cover is open.

FIGS. 3 and 4 show a general structure of a laser printer 1 according to this aspect. FIG. 3 shows the laser printer 1 when a cover 14 is in a closed state, while FIG. 4 shows the laser printer 1 when the cover 14 is in an open state. The terms "upward", "downward", "upper", "lower", "above", "below", "beneath", "front", "rear", "right", and "left" and the like will be used throughout the description assuming that the laser printer 1 is disposed in an orientation in which it is intended to be used. In use, the laser printer 1 is disposed as shown in FIG. 3.

As shown in the drawings, the laser printer 1 includes a main casing 2; a paper cassette 4 disposed in a bottom section of the main casing 2 for accommodating sheets of paper or other recording medium 3 in a stacked state, the paper cassette 4 capable of being pulled out of the main casing 2 in a forward direction; a feeding roller 5 disposed above a front end of the paper cassette 4 for conveying the paper 3 upward; and a feeding path 7 formed above the feeding roller 5 along which the paper 3 is conveyed from the feeding roller 5.

An access opening 8 is formed in the front surface of the main casing 2. A cartridge-accommodating section 9 is formed inside the main casing 2 to the rear of the access opening 8. Four process cartridges 10 corresponding to the colors black, cyan, magenta, and yellow are mounted in the cartridge-accommodating section 9 of the main casing 2 in a substantially vertically stacked arrangement. More specifically, the process cartridges 10 are stacked in a slanted direction so as to be positioned progressively rearward from bottom to top.

Each of the process cartridges 10 includes a toner-accommodating section 11 having a box shape for accommodating a toner, a photosensitive drum 12 on which an electrostatic latent image is formed, and a developing roller 13 for developing the electrostatic latent image formed on the photosensitive drum 12 into a visible image with toner supplied from the toner-accommodating section 11. Each process cartridge 10 is mounted in the cartridge-accommodating section 9 so that the toner-accommodating section 11 faces the access opening 8 side and the photosensitive drum 12 faces the rear side.

The cover 14 is disposed on the front surface of the main casing 2 and is capable of opening and closing over the access opening 8. The cover 14 has a thick plate-shape with a shaft part provided on an end thereof. The shaft part is attached to the main casing 2 near an upper edge of the access opening 8 so that the cover 14 can rotate about the shaft part. The cover 14 can be moved between a closed position shown in FIG. 3 in which the cover 14 covers the access opening 8, and an open position shown in FIG. 4 in which the opening 8 is exposed. In the closed position shown in FIG. 3, the cover 14 slopes downward toward the front of the main casing 2 following the slanted arrangement of the process cartridges 10. When in the open position shown in FIG. 4, the cover 14 retracts into a retracting space 15 that is defined above the access opening 8 and beneath a discharge tray 29 described later, and slopes slightly upward toward the front edge thereof. When the cover 14 is in this open position, the process cartridges 10 can be removed from the cartridge-accommodating section 9 via the access opening 8 in an upward sloping direction indicated by arrows in FIG. 4, or can be mounted in the cartridge-accommodating sections 9 in the opposite direction.

An exposure device 16 is integrally mounted on the inner side surface of the cover 14. The exposure device 16 includes a case 17 within which are provided a laser light-emitting unit 18 for emitting laser beams, a polygon mirror 19 that is driven to rotate, various lenses 20 and reflecting mirrors 21, and the like. The case 17 has an output wall 17A on its inner side. Since the output wall 17A is transparent with respect to laser beams, laser beams are outputted from the exposure device 16 through the output wall 17A. When the cover 14 is in the closed position, the output wall 17A opposes the front endface of the toner-accommodating section 11 in each process cartridge 10. When the cover 14 is in the open position, the output wall 17A faces downward. As illustrated by the broken line in FIG. 3, the laser light-emitting unit 18 of the exposure device 16 emits laser beams based on image data for each color, and the laser beams are irradiated through the output wall 17A onto the surfaces of the respective photosensitive drums 12, forming electrostatic latent images thereon.

An endless conveying belt 23 is disposed to the rear side of the cartridge-accommodating section 9 and is slanted upward toward the rear so as to oppose each of the photosensitive drums 12. When the feeding roller 5 feeds a sheet of paper 3 to the conveying belt 23 via the feeding path 7, the conveying belt 23 conveys the paper 3 obliquely upward to the rear so that one side surface (the surface facing forward) of the paper 3 sequentially opposes each of the photosensitive drums 12. Although not shown, transfer rollers are provided on the inside of the conveying belt 23 for opposing each of the photosensitive drums 12 and applying a transfer bias therebetween. As a result, of the transfer bias applied by the transfer rollers, toner images formed on the photosensitive drums 12 are sequentially transferred onto the paper 3.

A discharge path 24 for discharging the paper 3 from the main casing 2 is formed in the top section of the main casing 2 in a curved shape leading upward toward the front side surface of the main casing 2 (the side surface on which the cover 14 is provided) from a position at the top end of the conveying belt 23. The discharge path conforms to the shape of the paper 3 shown in the drawings. A fixing unit 25 is disposed immediately above the top end of the conveying belt 23 near the upstream side of the discharge path 24. The fixing unit 25 includes a heating roller 26 and a pressure roller 27 for fixing the toner image transferred onto the paper 3 to the surface of the paper 3 with heat, while conveying the paper 3 downstream. A pair of discharge rollers 28 is disposed along the discharge path 24 downstream of the fixing unit 25 (diagonally above and forward of the fixing unit 25). A discharge tray 29 is disposed further downstream (forward) of the discharge rollers 28. The discharge tray 29 extends toward the front of the main casing 2 and slopes upward toward the front edge. When the paper 3 is conveyed along the discharge path 24, the discharge rollers 28 discharge the paper 3 in a forward direction so that the sheets of paper 3 are discharged onto the discharge tray 29 with an image formation surface facing downward.

An original-reading unit 31 is disposed above the discharge tray 29 so as to cover the same. The original-reading unit 31 is a flatbed scanner configured of a main body 31A, and an automatic document feeder (ADF) 32 disposed above the main body 31A. The user lifts the ADF 32 upward to expose a document-supporting surface formed on top of the main body 31A. The original-reading unit 31 can read images from various documents placed on top of the document-supporting surface. A control panel 33 is also disposed on a top surface of the main body 31A that protrudes forward from the ADF 32. The control panel 33 enables the user to specify various operations to perform with the laser printer 1. The main body 31A of the original-reading unit 31 is fixed to the main casing 2 and cannot be withdrawn from a position above the discharge tray 29.

In the laser printer 1 described above, each of the process cartridges 10 is mounted so that the toner-accommodating section 11 faces the access opening 8 side and the photosensitive drum 12 is disposed in the rear side, while the exposure device 16 is integrally provided on the cover 14 and is capable of opening and closing together with the cover 14. Disposing the toner-accommodating section 11 on the near side in this way facilitates the user in handling the process cartridge 10 during a replacement operation.

Since the sheets of paper 3 are discharged in a direction toward the front side of the laser printer 1 on which the cover 14 is provided, establishing this side as the front of the laser printer 1 facilitates operations for retrieving the paper 3 from the discharge tray 29 and for mounting and removing the process cartridges 10. In addition, the paper cassette 4 is removed from the main casing 2 through the same front side of the laser printer 1, thereby facilitating operations for loading the paper 3 in the paper cassette 4.

Since the paper 3 is discharged onto the discharge tray 29 with the image formation surface (the surface of the paper 3 that has opposed the photosensitive drums 12) face down, the page order is maintained when printing a plurality of pages in succession.

Further, by disposing the process cartridges 10 in an obliquely stacked orientation, the discharge path 24 along which the paper 3 is discharged is disposed farther rearward than a comparative laser printer 1 in which the process cartridges 10 are stacked exactly vertically. Accordingly, the discharge tray 29 can be disposed deeper (farther rearward) in the main casing 2, thereby reducing the amount that the discharge tray 29 protrudes on the front side of the laser printer 1.

Since the paper 3 is discharged toward the same surface side on which the cover 14 is provided (forward), the paper 3 can be retrieved more easily from the discharge tray 29, even when the original-reading unit 31 is disposed above the discharge tray 29 so as to cover the same, than when the paper 3 is discharged in a direction away from the cover 14 (rearward).

Discharging the paper 3 in a forward direction toward the surface on which the cover 14 is disposed is particularly convenient in laser printers 1 having an original-reading unit that cannot be withdrawn for retrieving the paper 3 from the discharge tray 29.

Further, while the exposure device 16 emits laser beams for exposing photosensitive drums 12 through the output wall 17A, the cover 14 on which the output wall 17A is integrally provided opens in a manner that maintains the output wall 17A facing downward. Accordingly, this construction prevents dust from becoming deposited on the output wall 17A or the user from touching the output wall 17A or otherwise soiling the output wall 17A when the cover 14 is open.

By employing laser beams in the exposure device 16 for irradiation, the entire exposure device 16 can be separated farther from the photosensitive drums 12 than when exposure is performed using LEDs. Specifically, if the exposure device 16 employs LEDs, since LEDs must be disposed near the photosensitive drums, space must be provided around each process cartridge to prevent interference with the LEDs when the exposure device is opened and closed, adding to the overall size of the device. In contrast, an exposure device employing laser beams, as in this example, does not require the space used for LEDs and, hence, does not add any size to the device.

While the invention has been described in detail with reference to the above aspect thereof, it would be apparent to those skilled in the art that various changes and modifications may be made therein without departing from the spirit of the invention.

For example, the following variations are possible.

(1) While the process cartridges are stacked obliquely in the above description, the process cartridges may be stacked vertically.

(2) While the cover opens in an upward direction in the above description, the cover may be configured to open downward or to a side.

What is claimed is:

1. An image-forming apparatus comprising:

a main device body having a first side surface and a second side surface opposite to the first side surface, an opening being formed in the first side surface;

a cover configured to move between a closed position in which the cover covers the opening in the main device body and a fully opened position;

a plurality of process cartridges configured to be mounted in or removed from the main device body through the opening, the process cartridges being arranged in a row in the main device body when the process cartridges are mounted in the main device body, each process cartridge comprising a developer-accommodating section, an image-holding member, and a developing member, the developer-accommodating section accommodating developer, the image-holding member forming an electrostatic latent image thereon, the developing member developing the electrostatic latent image onto a developer image by using the developer supplied from the developer-accommodating section, thereby allowing the image-holding member to carry the developer image thereon;

an exposure device integrally provided on the cover and irradiating a light beam on each image-holding member to form the electrostatic latent image thereon, a conveying unit that conveys a sheet to a position opposing each image-holding member, thereby allowing the developer image to be transferred from each image-holding member onto the sheet; and a tray that supports the sheet after the sheet has been formed with the developer image from at least one of the image-holding members, wherein the cover has a side from which the exposure device emits light beams, the cover in the fully opened position allowing the side to face downward.

2. An image-forming apparatus according to claim 1, wherein the cover has a shaft portion at one end, the cover being rotatable about the shaft portion, the main device body defines an upper edge of the opening on the first side surface, the shaft portion being attached to the main device body at a position near to the upper edge of the opening.

3. An image-forming apparatus according to claim 1, wherein each process cartridge is oriented, when each process cartridge is mounted in the main device body, with its developer-accommodating section facing the first side surface and the image-holding member facing the second side surface;

wherein the image-forming apparatus further comprises an original-reading unit provided in the main device body, configured to read an image from an original document, wherein the original-reading unit is disposed above the tray and configured to cover the tray from above, when the image-forming apparatus is disposed in an orientation in which it is intended to be used.

4. An image-forming apparatus according to claim 3, wherein the exposure device includes a laser-emitting unit that emits laser beams as the light beams, the laser beams being irradiated on the image-holding members in the process cartridges.

5. An image-forming apparatus according to claim 3, wherein the process cartridges mounted in the main device body are arranged along an oblique direction such that a process cartridge on the bottom end is disposed nearest to the first side surface in the main device body, while other process cartridges sequentially above the lowest process cartridge are sequentially offset from the lowest process cartridge toward the second side surface of the main device body.

6. An image-forming apparatus according to claim 3, wherein the original-reading unit is fixed to the main device body.

7. An image-forming apparatus according to claim 3, wherein the cover has a wall through which the exposure device emits light beams, the wall facing downward when the cover opens while the image-forming apparatus is disposed in an orientation in which it is intended to be used.

8. An image-forming apparatus according to claim 3, further comprising a discharging unit discharging, after the sheet is formed with the developer images from all the image-holding members, the sheet onto the tray in a discharge direction that is defined from the second side surface to the first side surface of the main device body.

9. An image-forming apparatus according to claim 8, wherein:

the main device body further has a third side surface and a fourth side surface opposite to the third side surface, a direction defined between the third and fourth side surfaces being orthogonal to a direction defined between the first and second side surfaces, the conveying unit conveys the sheet from its upstream and to its downstream end, the upstream end facing the third side surface and the downstream end facing the fourth side surface; and the main device body is formed with a sheet-discharging path that curves from a position near the downstream end of the conveying unit in a direction from the second side surface toward the first side surface and leads to the tray.

10. An image-forming apparatus according to claim 8, wherein when the image-forming apparatus is disposed in an orientation in which it is intended to be used, the process cartridges are arranged substantially vertically in the main device body when the process cartridge are mounted in the main device body.

11. An image-forming apparatus according to claim 10, wherein when the image-forming apparatus is disposed in an orientation in which it is intended to be used, the conveying unit conveys the sheet in an upward direction from its upstream end to its downstream end; and wherein the main device body is formed with a sheet-discharging path that curves from a position near an upper end of the conveying unit in a direction from the second side surface toward the first side surface and leads to the tray.

12. An image-forming apparatus according to claim 8, wherein the main device body further has a third side surface and a fourth side surface opposite to the third side surface, a direction defined between the third and fourth side surfaces being orthogonal to a direction defined between the first and second side surfaces; and, wherein the original-reading unit being disposed nearer to the fourth side surface than the tray so as to cover the tray from a side of the fourth side surface.

13. An image-forming apparatus according to claim 12, wherein the original-reading unit is fixed to the main device body.

14. The image-forming apparatus according to claim 3, wherein the original-reading unit is a flatbed scanner.

15. The image-forming apparatus according to claim 14, wherein the flatbed scanner further comprises:

a main scanner body; and an automatic document feeder.

16. The image-forming apparatus according to claim 15, wherein the flatbed scanner is configured to expose a document-supporting surface formed on top of the main body when the automatic document feeder is lifted upward.

17. The image-forming apparatus according to claim 15, further comprising a control panel disposed on top of the main scanner body.

18. An image-forming apparatus comprising:

a device body comprising a first wall and a second wall opposite the first wall, wherein the first wall has an opening formed therethrough;

a cover configured to move between a closed position in which the cover covers the opening and a fully opened position;

a plurality of process cartridges configured to be selectively mounted in and removed from the main device body via the opening, wherein each of the process cartridges comprises a developer-accommodating section and an image-holding member, and when each of the process cartridges is mounted in the main device body, the developer-accommodating section faces the first wall and the image-holding member faces the second wall; and an exposure device provided on the cover, wherein the exposure device irradiates a light beam on each image-holding member to form an electrostatic latent image thereon, wherein the cover has a side from which the exposure device emits light beams, and the cover in the fully opened position allowing the side to face in a downward direction.

* * * * *